United States Patent [19]

Bursk

[11] 4,241,556

[45] Dec. 30, 1980

[54] DOOR LIGHT ASSEMBLY

[75] Inventor: William M. Bursk, Middletown, Ohio

[73] Assignee: Pease Company, Fairfield, Ohio

[21] Appl. No.: 958,981

[22] Filed: Nov. 9, 1978

[51] Int. Cl.[3] ..... E06B 3/70

[52] U.S. Cl. ..... 52/455; 52/822; 49/171

[58] Field of Search ..... 52/455, 208, 822, 212, 52/214, 656; 49/171

[56] References Cited

U.S. PATENT DOCUMENTS

| | | | |
|---|---|---|---|
| 3,203,052 | 8/1965 | Curtis, Jr. | 49/171 X |
| 3,704,563 | 12/1972 | Waller | 52/455 |
| 3,903,669 | 9/1975 | Pease, Jr. et al. | 52/455 |
| 4,006,571 | 2/1977 | Bursk | 52/397 X |
| 4,021,967 | 5/1977 | Mulder et al. | 52/455 X |
| 4,128,977 | 12/1978 | Schubeis | 52/212 |

*Primary Examiner*—Carl D. Friedman

*Attorney, Agent, or Firm*—Biebel, French & Nauman

[57] ABSTRACT

A door light assembly in which a door light and interior and exterior molding members are secured in a door by an improved security clip. The clip is formed from a single piece of spring steel sheet metal and is adapted to be attached to the exterior molding member by means of a screw. Portions of the clip engage the adjacent edges of the door light and the door to hold the door light in place in the door, while other portions of the clip provide an attachment for the interior molding member. The resulting construction provides greater security since the exterior molding member is locked positively in place by means of screws, while at the same time the construction is aesthetically pleasing in that the screw heads are concealed.

9 Claims, 3 Drawing Figures

DOOR LIGHT ASSEMBLY

BACKGROUND OF THE INVENTION

In a typical door light assembly a flat panel or panels of glass or other material are secured in an opening or openings in a door. Interior and exterior molding sections are used to both cover the joint between the adjacent edges of the door and panel or panels received in the door opening and to hold the panel in place.

In U.S. Pat. No. 3,903,669, dated Sept. 9, 1975, a construction is shown in which the interior and exterior molding members are provided with inwardly projecting bosses having sockets formed therein for the reception of interconnecting pins. This construction allows the panels to be held in place by the molding members.

In U.S. Pat. No. 4,006,571, dated Feb. 8, 1977, a similar construction is shown in which, instead of a pin to secure the interior and exterior molding sections together, a winged, sheet metal, tubular clip is utilized which slips over and grips inwardly projecting bosses on the interior and exterior molding sections.

In both of the door light assemblies disclosed in the two, above noted patents, the panels are actually held in the openings in the door by the molding sections themselves, and will be appreciated that the process of assembling the molding members around the panels and doors is necessarily time consuming.

SUMMARY OF THE INVENTION

The present invention provides an improved door light assembly which utilizes a one-piece, spring steel security clip which is attached to the exterior molding by means of screws or the like to deter forceable removal of the exterior molding from the assembly, with the clip having portions which actually engage the adjacent edges of the panel and door to hold the panel in place independently of the interior molding.

The clip also includes prongs which engage inwardly projecting portions of the interior molding member to allow the interior molding to be simply pushed into place once the panels have been assembled in the door.

Specifically, the security clip has a substantially flat base section having an opening therethrough through which a screw passes and is threaded into an inwardly projecting stud on the exterior molding. This secures the clip to the exterior molding, and by means of portions of the clip formed integrally with the base, secures the panel in the door.

The sections of the clip which engage the door and the panel are formed somewhat differently to provide some adjustment of the section engaging the panel to accommodate panels of different thicknesses, such as, for example, a single pane of glass as opposed to an insulating panel comprised of a pair of spaced panes of glass.

The prongs which engage the inwardly projecting boss on the interior molding are punched out of the spring steel forming the clip and project inwardly toward the base so that any tendency to remove the interior molding is resisted by the tips of the prongs digging into the material of the boss.

As a result a simplified but more secure door light assembly is provided which is nonetheless more aesthetically pleasing because of the elimination of visible screw heads.

DESCRIPTION OF THE PREFERRED EMBODIMENTS

Figure 1:
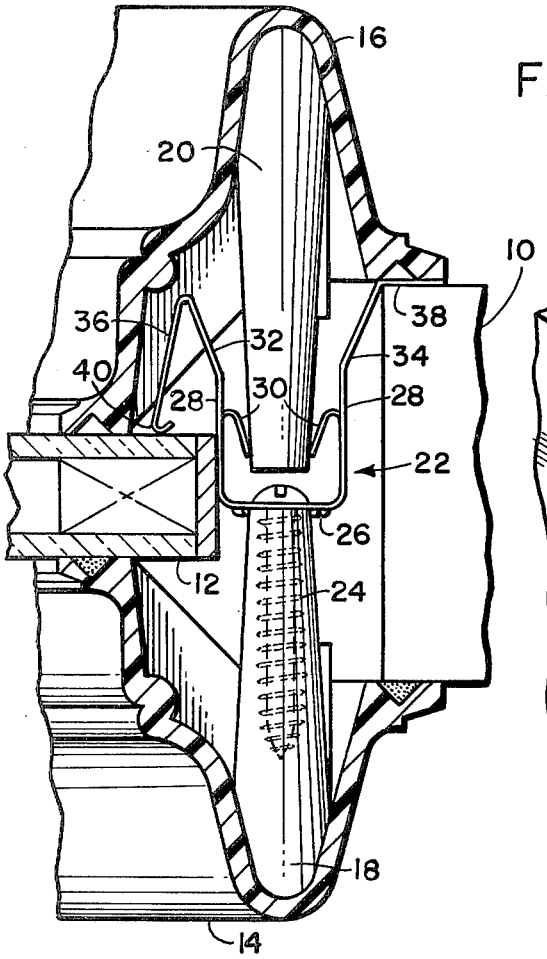
FIG. 1 is a view, partly in section, through a portion of a door light assembly in accordance with the present invention.
Figure 2:
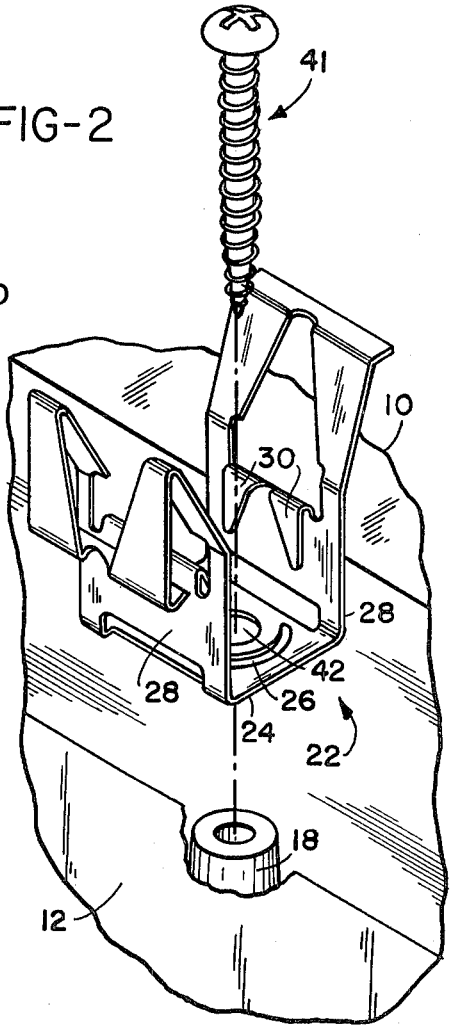
FIG. 2 is an exploded perspective view of a portion of the door light assembly of the present invention.
Figure 3:
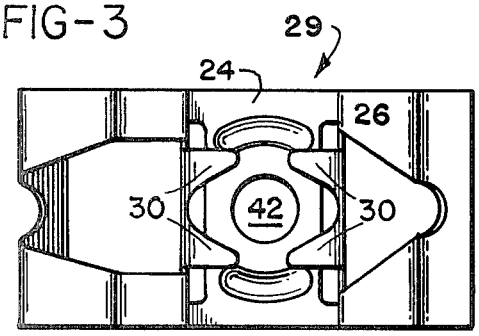
FIG. 3 is a plan view of the security clip per se.

A door light assembly in accordance with the present invention includes a door, a portion of which is shown at 10, having an opening or openings formed therein to receive a panel or panels, such as an insulating double paned glass panel, a portion of which is shown at 12. The assembly also includes an exterior molding 14 and an interior molding 16, each of which are provided with inwardly projecting portions or bosses 18 and 20, respectively.

The panel 12 is secured in place in the door 10 by means of a security clip 22. The clip 22 is formed of a single piece of spring steel and includes a substantially flat base section 24 which may be provided with reenforcing ribs 26. A pair of legs 28 project away from the base section along opposite sides thereof and carry pairs of opposed prongs 30 which are struck out from the material of the clip and project inwardly towards each other and the base section 24. Wing portions 32 and 34 extend from the legs outwardly away from the base section and towards the interior molding 16 and terminate in the foot portions 36 and 38.

Foot portion 38 is designed to rest on the edge of the door 10 at the area thereof around the opening therethrough. Foot portion 36, on the other hand, is designed to project downwardly and with its reversely bent portion 40, engage the edge of a panel 12 received in the door. With this construction of the foot portion 36 panels of different thicknesses can be readily accommodated within the opening in the door.

In assembling the door light construction of the present invention the exterior molding is positioned about the opening in the door and the panel 12 laid in place. A plurality of clips 22 are then secured to the exterior molding by means of the screws 41 which pass through the openings 42 in the base sections of the clips and penetrate the inwardly projecting portions 18 of the exterior molding. This then fixes the panel in the door in a positive manner, independently of the interior molding 16, and in a manner which deters forceable removal of the exterior molding.

The interior molding can then be simply pushed into place with the legs 28 and prongs 30 cooperating to provide resilient gripping means to engage the inwardly projecting portions 20 on the interior molding 16. The projection of the prongs inwardly toward each other and their base sections 24 causes them to engage the portions 20 of the molding 16 and resist its removal.

From the above it will be seen that the present invention provides an improved door light assembly which includes a security clip which facilitates construction of the assembly and deters forceable removal of the exterior molding without detracting from the overall appearance of the assembly.

While the product herein described constitutes a preferred embodiment of the invention, it is to be understood that the invention is not limited to this precise product, and that changes may be made therein without departing from the scope of the invention.

What is claimed is:

1. In combination with a door light assembly including a door having an opening therethrough, a panel positioned in said opening in substantially coplaner relationship to said door, interior and exterior molding engaging adjacent edges of said panel and said door around said opening therethrough, and inwardly projecting portions on said molding sections positioned intermediate said edges of said panel and said door, the improvement comprising:

a security clip having a substantially flat base section with an opening therethrough, fastening means projecting outwardly from said base section through said opening, penetrating said inwardly projecting portion of said exterior molding, and securing said base section to said exterior molding, and resilient gripping means projecting from said base section in a direction opposite to said fastening means and gripping said inwardly projecting portion of said interior molding.

2. The assembly of claim 1 wherein:

said gripping means includes pairs of legs projecting away from said base section toward said interior molding, and prong means projecting inwardly from said legs towards said base section and engaging said inwardly projecting portion of said interior molding.

3. The assembly of claim 1 wherein:

said clip further includes wing portions projecting outwardly away from said base section toward said interior molding.

4. The assembly of claim 3 wherein:

said wing portions terminate in foot portions engaging said edges of said panel and said door.

5. The assembly of claim 4 wherein:

said foot portion engaging said panel projects outwardly with respect to said base section and toward said exterior molding.

6. The assembly of claim 5 wherein:

said panel-engaging foot portion terminates in a reversely bent portion.

7. The assembly of claim 1 wherein:

said inwardly projecting portions of said interior and exterior molding comprise studs formed integrally with said molding.

8. The assembly of claim 1 wherein:

said fastening means comprises a screw threaded into said inwardly projecting portion of said exterior molding.

9. In combination with a door light assembly including a door having an opening therethrough, a panel positioned in said opening in substantially coplanar relationship to said door, interior and exterior molding engaging adjacent edges of said panel and said door around said opening through said door, and inwardly projecting studs formed integrally with said molding sections, the improvement comprising:

a one-piece, sheet metal, spring steel security clip having a substantially flat base section with an opening therethrough, a screw passing through said opening in said base section and threaded into said inwardly projecting stud on said exterior molding, securing said base section to said exterior molding, a pair of legs projecting from said base section along opposite sides thereof and carrying pairs of opposed prongs which project inwardly toward each other and said base section in engagement with said stud on said interior molding, wing portions projecting outwardly away from said base and toward said interior molding and terminating in foot portions engaging said edges of said panel and said door, and said panel engaging foot portion projecting outwardly away from said base and toward said exterior molding and terminating in a reversely bent portion.

* * * * *